US012495904B2

(12) United States Patent
Parsons et al.

(10) Patent No.: US 12,495,904 B2
(45) Date of Patent: Dec. 16, 2025

(54) TATTOO REST APPARATUS

(71) Applicants: Jacob F. Parsons, Denver, CO (US); Joshua F. Parsons, Denver, CO (US)

(72) Inventors: Jacob F. Parsons, Denver, CO (US); Joshua F. Parsons, Denver, CO (US)

( * ) Notice: Subject to any disclaimer, the term of this patent is extended or adjusted under 35 U.S.C. 154(b) by 171 days.

(21) Appl. No.: 18/478,475

(22) Filed: Sep. 29, 2023

(65) Prior Publication Data

US 2024/0115049 A1 Apr. 11, 2024

Related U.S. Application Data

(60) Provisional application No. 63/379,018, filed on Oct. 11, 2022.

(51) Int. Cl.

| | |
|---|---|
| ***A47C 1/11*** | (2006.01) |
| ***A47C 7/38*** | (2006.01) |
| ***A47C 7/54*** | (2006.01) |
| ***A47C 7/72*** | (2006.01) |

(52) U.S. Cl.

CPC ..... *A47C 1/11* (2013.01); *A47C 7/383* (2013.01); *A47C 7/546* (2013.01); *A47C 7/725* (2013.01); *A47C 7/727* (2018.08)

(58) Field of Classification Search

CPC ..... A47C 7/546; A47C 7/727; A47C 7/725; A47C 7/383; A47C 7/425; A47C 1/11

USPC ..... 297/411.23

See application file for complete search history.

(56) References Cited

U.S. PATENT DOCUMENTS

| | | | | |
|---|---|---|---|---|
| 3,046,573 | A * | 7/1962 | Davis, Sr. | B60N 2/787 5/652 |
| 5,829,832 | A * | 11/1998 | Molee | A47C 7/383 297/391 |
| 7,261,374 | B2 * | 8/2007 | Potosky | A47C 7/546 297/227 |
| 7,431,392 | B2 * | 10/2008 | Tamara | A47C 7/72 297/217.4 |
| 7,431,396 | B1 * | 10/2008 | Dasso | A47C 7/546 297/227 |
| 2009/0315381 | A1 * | 12/2009 | Longnecker | B64D 11/0647 297/411.23 |
| 2016/0249745 | A1 * | 9/2016 | Marton | A47C 31/007 297/227 |

FOREIGN PATENT DOCUMENTS

| | | | | |
|---|---|---|---|---|
| CN | 2935262 Y | * | 8/2007 | |
| CN | 104257163 A | * | 1/2015 | A47C 31/00 |

* cited by examiner

*Primary Examiner* — Milton Nelson, Jr.
(74) *Attorney, Agent, or Firm* — Kubota & Basol LLP

(57) ABSTRACT

The present invention is directed toward a tattoo rest apparatus in the form of a bolster which is adapted for use individually upon a surface such as a table-top, interconnection to a structure such as a seat-back of a chair through wherein clamping elements are used to secure the tattoo rest apparatus to the structure. Alternately, the tattoo rest apparatus can be used in conjunction with a stand, such as a roller-stand with the roller removed, wherein tabs of the stand are inserted through apertures adapted for interconnecting with the stand.

17 Claims, 11 Drawing Sheets

TATTOO REST APPARATUS

CROSS REFERENCE TO RELATED APPLICATIONS

This application claims the benefit of U.S. Provisional Patent Application 63/379,018 entitled "TATTOO REST APPARATUS" filed on Oct. 11, 2022, the entire contents of which are incorporated herein by reference in its entirety for all purposes.

FIELD OF THE INVENTION

The present invention is directed to a bolster intended for use in the tattoo art industry, for providing a comfortable rest for a tattoo artists as well as for a tattoo client when receiving tattoo work. Furthermore, the present invention can be used in industries such as the massage therapy industry, and other industries wherein a comfortable rest is advantageous for use for long periods of sitting, standing, laying down, or otherwise remaining stationary while receiving or providing body work.

BACKGROUND OF THE INVENTION

A practice of art and expression of culture and personality, tattoos have a long history with the earliest known tattoos dating between 3370 and 3100 B.C. The evolution of the practice of tattoo art, while vast, art surrounds a common thread throughout. The first main commonality across the tattoo practice involves inserting ink, dyes, and/or pigments into the dermis layer of the skin to create a desired pattern or design. The second main commonality in present day tattoo work is that the tattoo art is typically performed by embedding ink or other permanent coloration into the dermal layer of skin for a permanent design wherein most tattoo art is performed with a tattoo artist performing the tattooing, and a tattoo recipient or tattoo client receiving the tattoo art.

When tattoo work is being performed—due to the permanent nature of the art—it is of the utmost importance that the tattoo client remain still, and the tattoo artist keep a steady hand. As a result, tattoo artists and tattoo recipients alike will use tables, chairs, and rests specifically designed to provide a stable structure to rest upon in an established tattoo studio. It is particularly important that such rests provide a comfortable surface as tattoo artists and tattoo recipients commit to long tattooing sessions, and comfort reduces fatigue and enables remaining still in a given position for longer periods of time.

While the rests that are provided in the prior art are effective, they do not address the need for a rest for tattoo artists and tattoo recipients alike to use when not in an established tattoo studio. Tattoo artists and tattoo recipients often travel for conventions and events where they may provide or receive tattooing services. Furthermore, a tattoo artist may provide tattoo services away from their studio such as in another tattoo artists studio, or at a client's home for instance wherein the artist wishes to provide tattoo work in a more private setting. Thus, there is a need for a stable and comfortable rest for use in the tattoo industry wherein the rest is compact and modular for a variety of situations.

SUMMARY OF THE INVENTION

Existing tattoo rests typically include a padded planar element which is pivotally connected to a stand wherein the padded planar element can be pivoted to accommodate a variety of angles and heights to allow customization for use by the tattoo artist and the tattoo recipient. The challenge with such tattoo rests stems from the transportability of such a design. The legs are typically metal, and the padded planar element is typically made to be oversized for its intended purpose to allow for more flexibility in use. Thus, the existing tattoo rest is typically too cumbersome and heavy for use as a transportable apparatus. While embodiments of the present invention are described and depicted herein as having legs interconnected thereto, the present invention can also be used independently when rested upon an existing surface such as on a table, floor, or other surface.

It is an aspect of certain embodiments of the present invention to provide an easily transportable and lightweight tattoo rest apparatus. Furthermore, it is an aspect of the present invention to provide a tattoo rest apparatus that does not require the use of a stand. Further still, it is an aspect of certain embodiments of the present invention to support use in a variety of angles for support without requiring the pivotal adjustability of the tattoo rest apparatus in relation to a static stand.

In certain embodiments of the present invention, a tattoo rest apparatus comprises a compact form having a round or polygonal cross section wherein the tattoo rest apparatus can be used in a variety of angles. The round or polygonal shape (such as an octagonal, hexagonal, or other polygonal shape) allows a user to rest their arm or hand in a variety of manners to provide support at a variety of angles without the need to rotate or pivotally adjust the tattoo rest apparatus. Embodiments described herein are not limited to use to rest an arm or hand, embodiments of the present invention can be used to provide support for a user's back, legs, or other portion of their body as desired.

In certain embodiments of the present invention, a tattoo rest apparatus is configured to rest on an existing surface such as a table-top or floor while providing support as required for a tattoo artist or tattoo recipient, and further allow the interconnection of the tattoo rest apparatus to an existing structure. At conventions and trade shows for instance, the use of a standard folding chair, and standard folding tables are widely used. Thus, it may be desired to allow the modular interconnection of the tattoo rest apparatus of certain embodiments to a folding chair or other commonly found item.

In certain embodiments, a tattoo rest apparatus of the present invention comprises a recess adapted for receiving a top portion of a folding chair, or an edge of a folding table to provide a stable and supportive surface for a tattoo artist or tattoo recipient as desired.

In certain embodiments, the interconnection between the tattoo rest apparatus of certain embodiments and existing objects for support include the use of a clamping feature wherein the clamping feature constrains the tattoo rest apparatus to the top portion of a folding chair, an edge of a table, or other structures that fit within the recess.

Furthermore, existing tattoo rests do not accommodate for providing ample lighting for illuminating the area where a tattoo recipient is receiving tattoo work. While lighting is easily controlled in a tattoo studio, lighting provided at a convention, trade show, or client's home is unpredictable and more difficult to control. In certain embodiments a tattoo rest apparatus of the present invention provides a power source wherein a light source can be plugged into the tattoo rest apparatus for task lighting to further illuminate the area of the tattoo recipient's body which is resting upon the tattoo rest apparatus.

Further still, as tattoo artists and tattoo recipients enjoy music while tattooing, it is an aspect of the present invention to provide a speaker for music enjoyment. In certain embodiments tattoo rest apparatus comprises a speaker within the external envelope of the tattoo rest apparatus allowing a user to play music as desired. A speaker as disclosed herein can be a wired or wireless speaker as desired while in keeping with the spirit and scope of the present invention.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION OF VARIOUS EMBODIMENTS

Figure 1A:
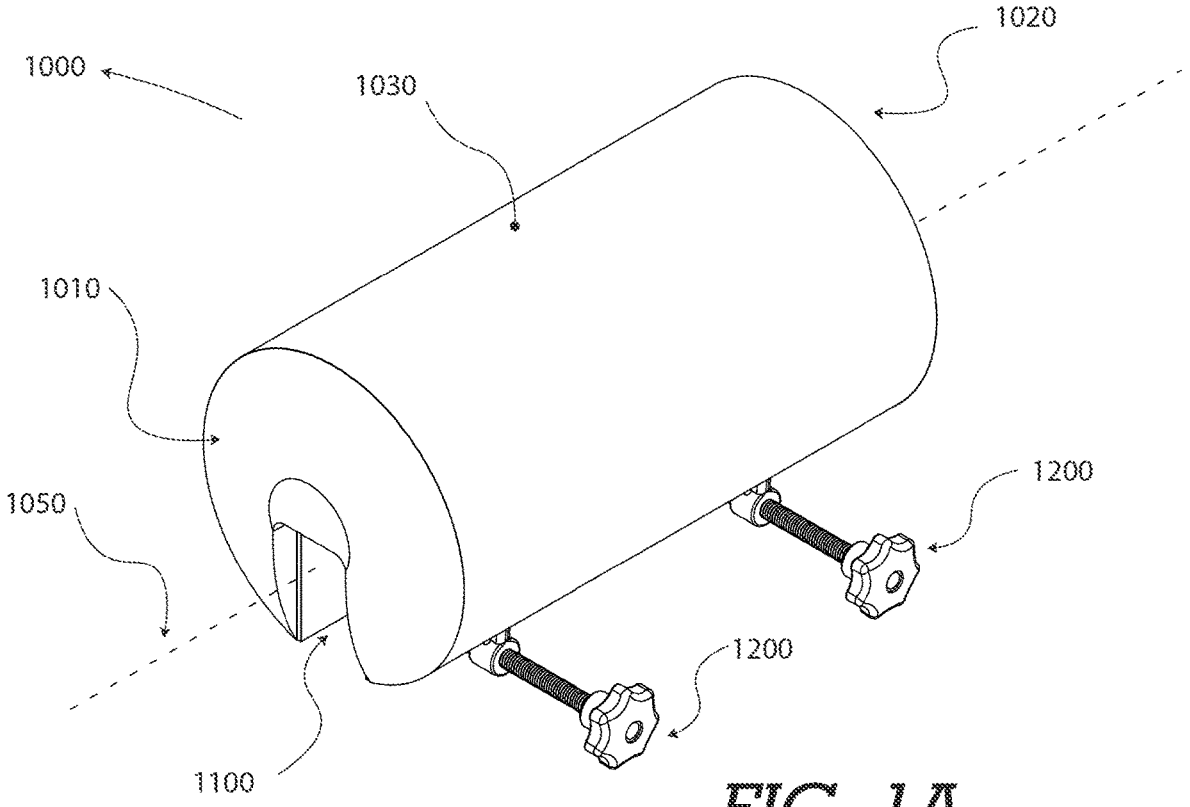
FIG. 1A—A perspective view of certain embodiments of a tattoo rest apparatus FIG. 1B—A perspective view of certain embodiments of a tattoo rest apparatus FIG. 2—An end view of certain embodiments of a tattoo rest apparatus FIG. 3—A side view of certain embodiments of a tattoo rest apparatus FIG. 4—A bottom view of certain embodiments of a tattoo rest apparatus FIG. 5—A perspective view of certain embodiments of the present invention interconnected to a chair FIG. 6—An exploded perspective view of certain embodiments of the present invention interconnected to a roller-stand FIG. 7A—A perspective transparent view of certain embodiments of a tattoo rest apparatus FIG. 7B—A perspective transparent view of certain embodiments of a tattoo rest apparatus FIG. 8—A perspective view of certain embodiments of a tattoo rest apparatus FIG. 9—A perspective exploded view of certain embodiments of the present invention FIG. 10—A perspective view of certain embodiments of a tattoo rest apparatus
Figure 1B:
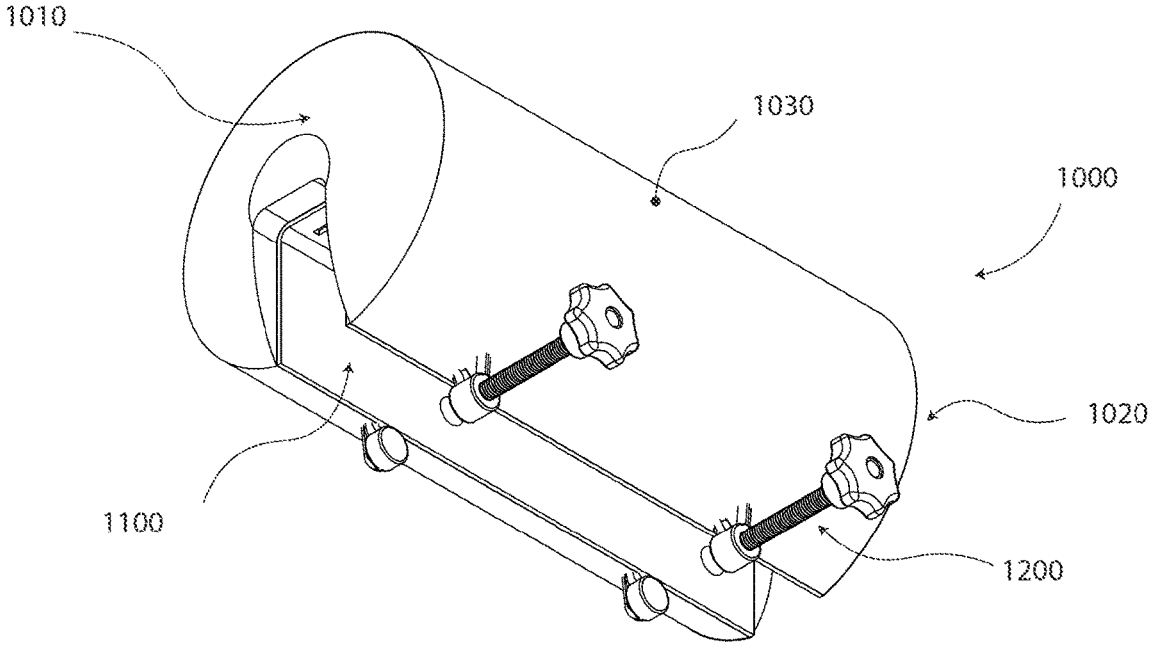
Figure 2:
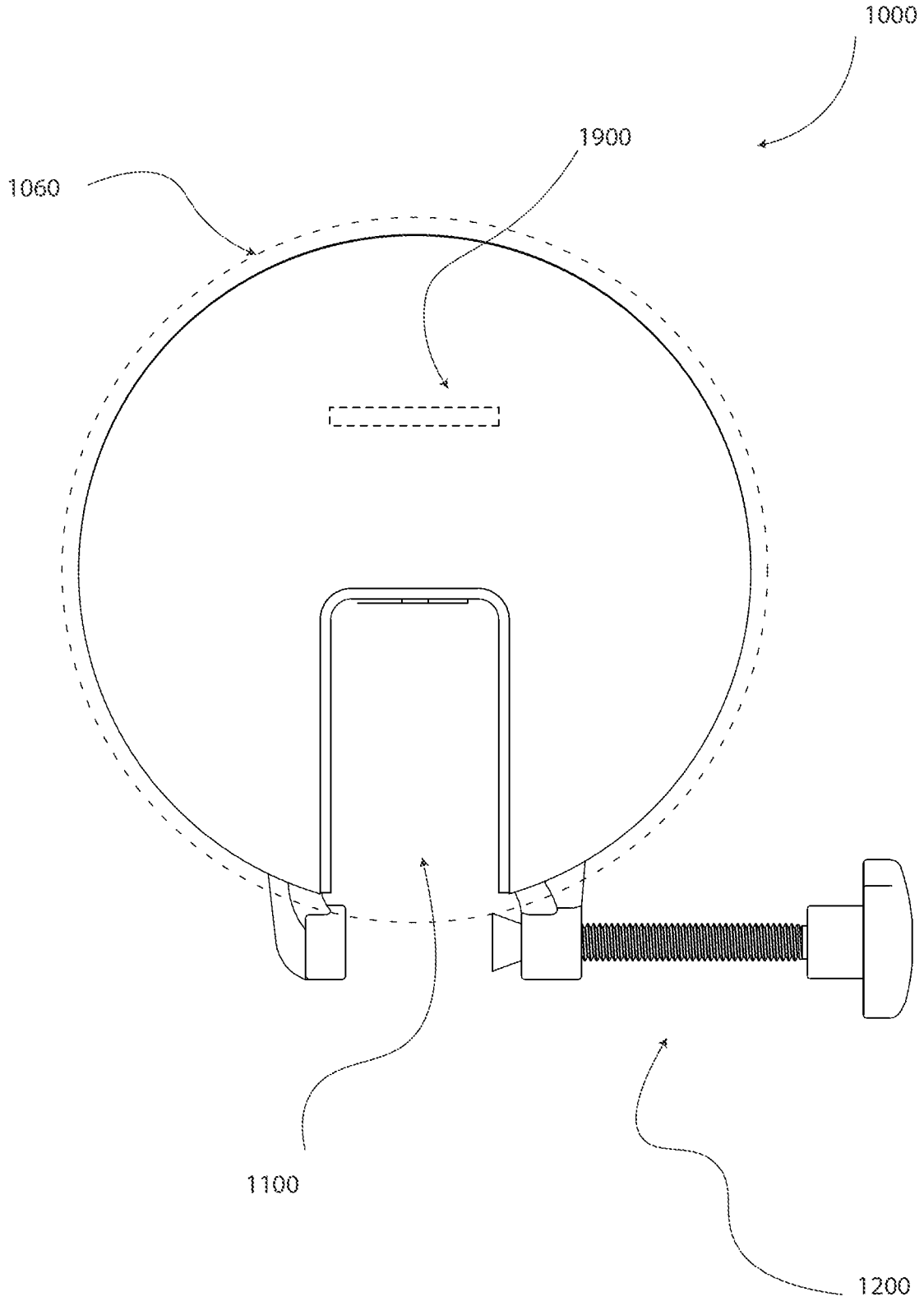
Figure 3:
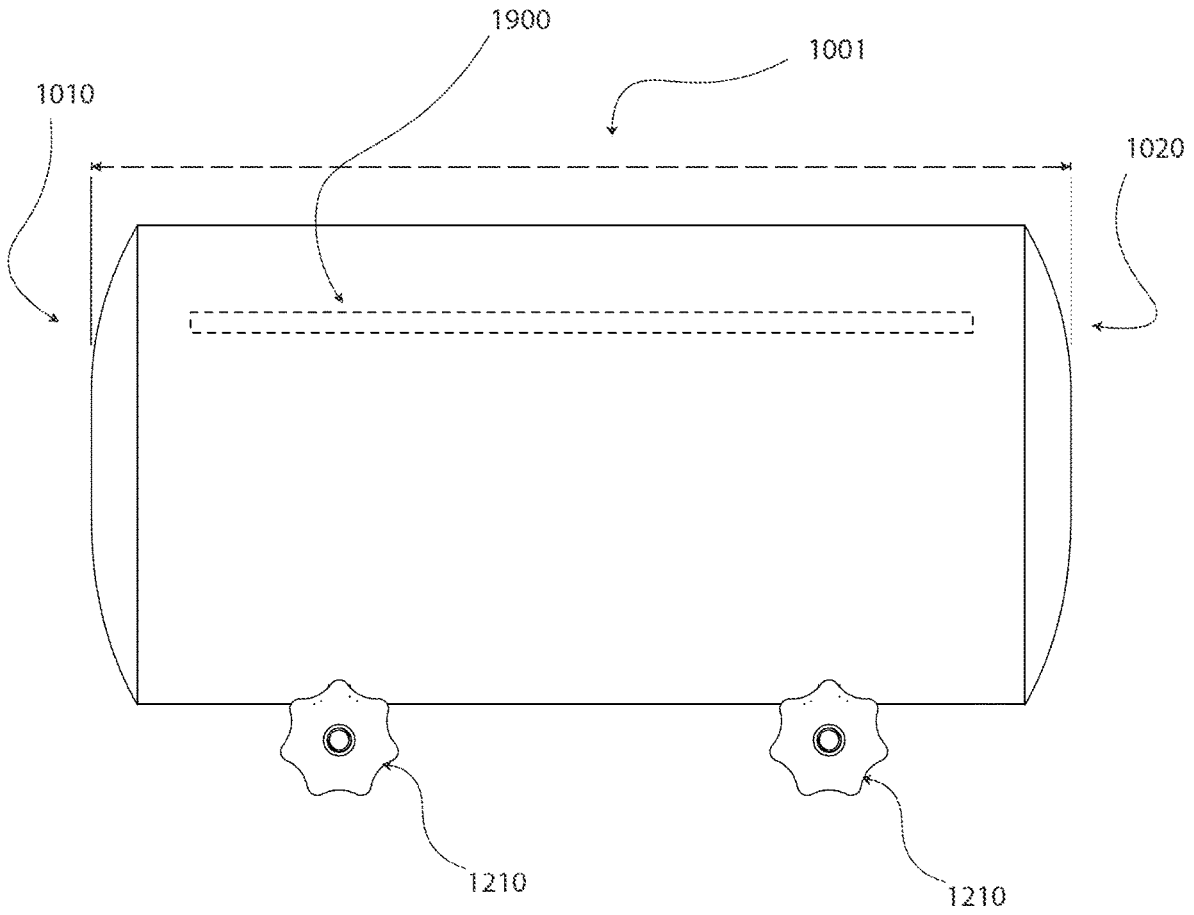

Certain embodiments of the present invention, shown in FIG. 1A-FIG. 4 for instance, comprise a tattoo rest apparatus 1000 comprising a longitudinal axis 1050 and a cross section 1060 which extends from a first side 1010 to a second side 1020 of the tattoo rest apparatus oriented along the longitudinal axis 1050. In certain embodiments the cross-section 1060 of the tattoo rest apparatus is consistent from the first end 1010 to the second end 1020. However, alternate embodiments comprising a varying cross-section 1060 are within the spirit and scope of the present invention. Embodiments comprising a tattoo rest apparatus 1000 having a cross-section 1060 between the first end 1010 and the second end 1020 of the tattoo rest apparatus, wherein the external aspect 1030 of the tattoo rest apparatus comprises recesses, protrusions, or undulations are within the spirit and scope of the present invention.

In certain embodiments, a tattoo rest apparatus 1000 comprises a generally round cross-section 1060 extending from the first end 1010 of the tattoo rest apparatus to the second end 1020 of the tattoo rest apparatus. While a round cross-section shape is shown in embodiments shown herein, cross-sections comprising ellipsoid shapes, ovoid shapes, polygonal shapes, or other shapes comprising linear aspects, curvilinear aspects, or a combination thereof are within the spirit and scope of the present invention.

In certain embodiments, a tattoo rest apparatus 1000 comprises a longitudinal recess 1100 extending parallel to the longitudinal axis 1050. In certain embodiments, the longitudinal recess 1100 extends longitudinally through the first end 1010 of the tattoo rest apparatus and the second end 1020 of the tattoo rest apparatus wherein the first end 1110 and the second end 1120 of the channel are open. Thus, the tattoo rest apparatus 1000 can be interconnected to objects having a length longer than the length 1001 of the tattoo rest apparatus. Alternate embodiments comprise a longitudinal recess 1100 comprising a first end 1110 offset inward from the first end 1010 of the tattoo rest apparatus, and wherein the longitudinal recess further comprises a second end 1120 offset inward from the second end 1020 of the tattoo rest apparatus. In such alternate embodiments, the tattoo rest apparatus 1000 is only capable of interconnecting with objects having a length shorter than the length 1101 of the longitudinal recess.

Certain embodiments of the present invention, as shown in FIG. 1A-FIG. 5 for instance, comprise a first clamping element 1200 which is adapted for clamping to an object which is received within the longitudinal recess 1100. The first clamping element 1200 is configured to span at least a portion of width 1102 of the longitudinal recess wherein the first clamping element 1200 is adapted for clamping to an object inserted within the longitudinal recess. By clamping to an object, such as a folding chair 9000 or table, the tattoo rest apparatus is thereby constrained to the object for stable use. While a screw type C-clamp is shown with rotatable knobs 1210, clamping apparatus of all types are within the spirit and scope of the present invention including, F-clamps, spring clamps, ratcheting clamps, vise clamps, sliding clamps, cardellini clamps, locking clamps, Marman clamps, parallel clamps, quick action clamps, and toggle clamps.

Figure 4:
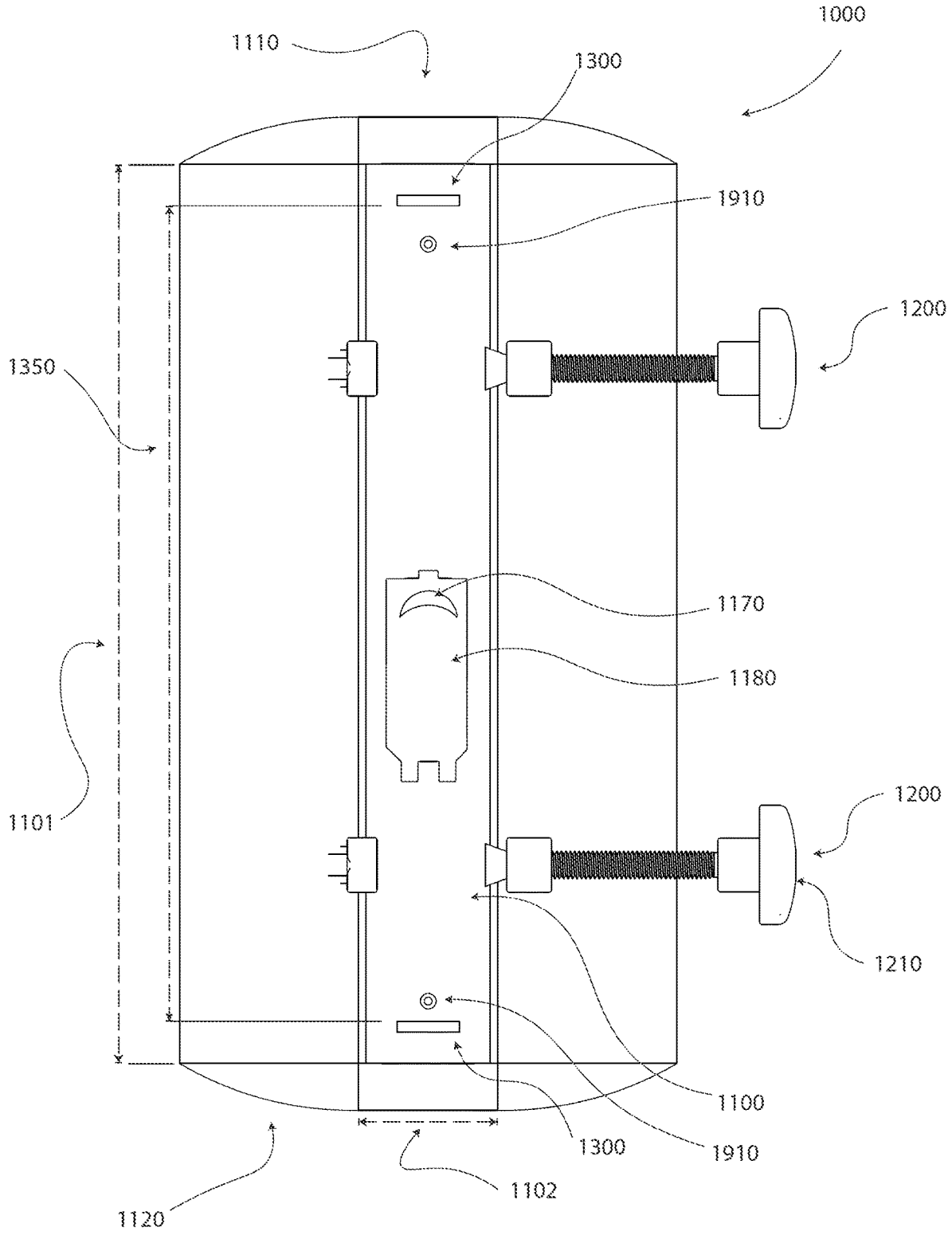
Figure 5:
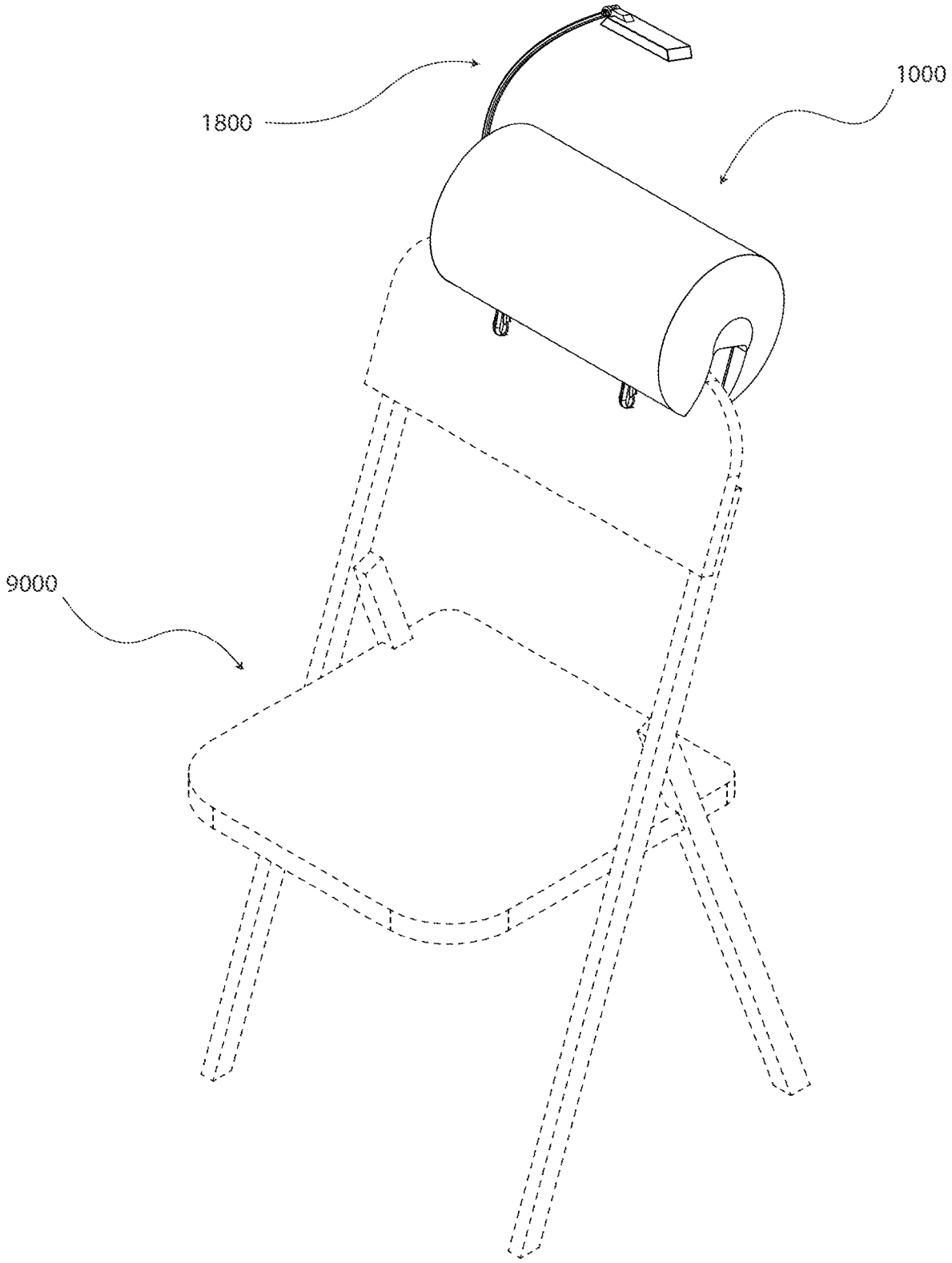
Figure 6:
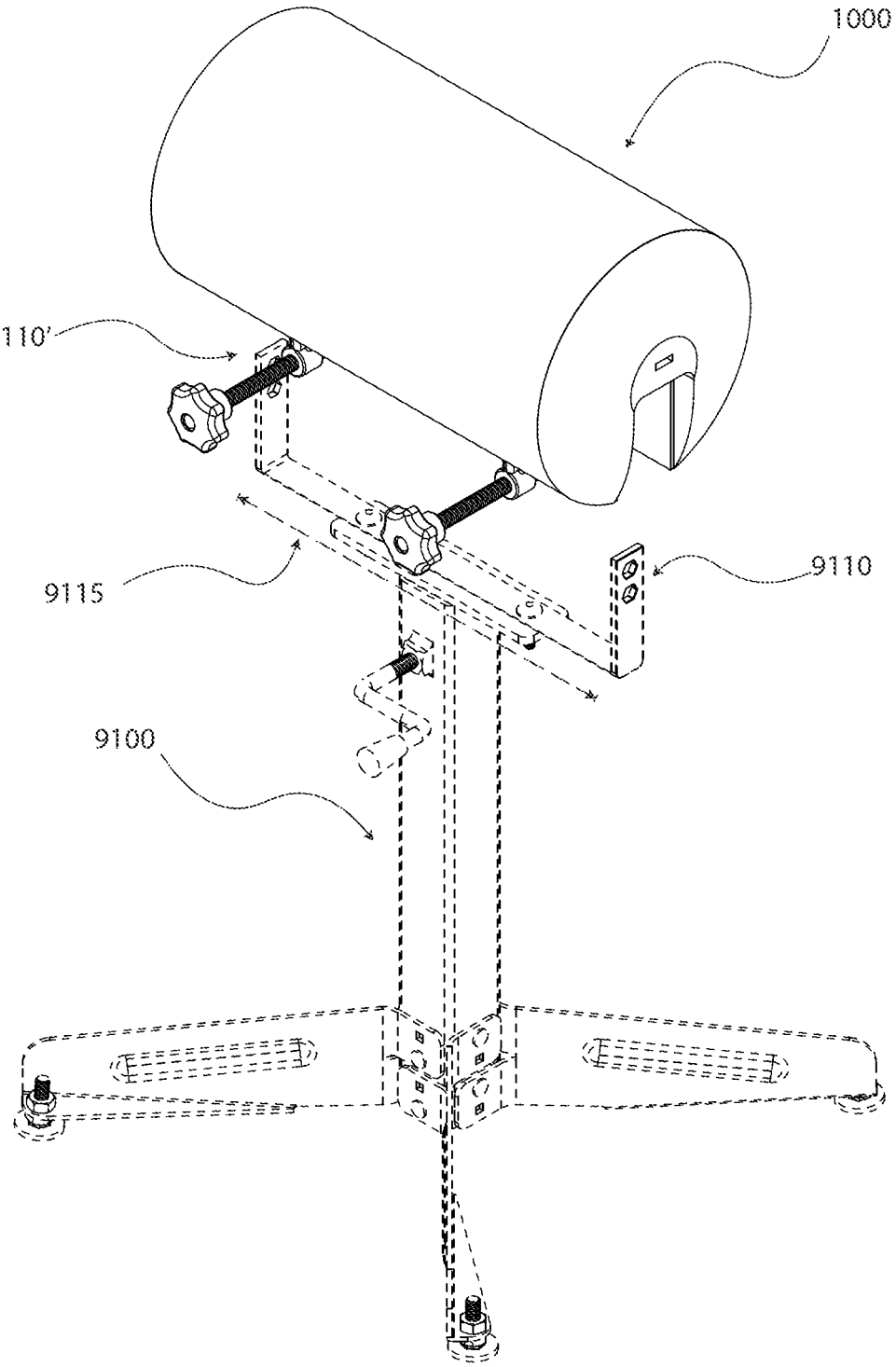

In certain embodiments, as seen in FIG. 4 and FIG. 6 for instance, the longitudinal recess 1100 further comprises a first rectilinear aperture 1300, and a second rectilinear aperture 1300' through the bottom surface 1150 of the longitudinal recess. The rectilinear apertures 1300 are configured for interconnecting with a commonly available roller stand 9100 wherein the roller has been removed, thus leaving a first tab 9110 and a second tab 9110' extending upward. The rectilinear apertures 1300 are configured to receive the tabs 9110 to allow the tattoo rest apparatus 1000 to be interconnected with the roller stand 9100. As there are multiple brand and size roller stands 9100 wherein the distance 9115 between the first tab 9110 and the second tab 9110' may vary, the aperture offset 1350 of certain embodiments can be adjusted as desired to match the distance 9150 between the first tab and the second tab. Furthermore, embodiments comprising a plurality of rectilinear apertures 1300 to accommodate a plurality of alternative roller stands 9100 are within the spirit and scope of the present invention. Further still, while embodiments shown comprise a roller stand with the roller removed for interconnecting therewith, alternate embodiments of the present invention comprising a tattoo rest apparatus configured to interconnect to alternate structures, or alternate utility stands, are within the spirit and scope of the present invention.

Figure 7A:
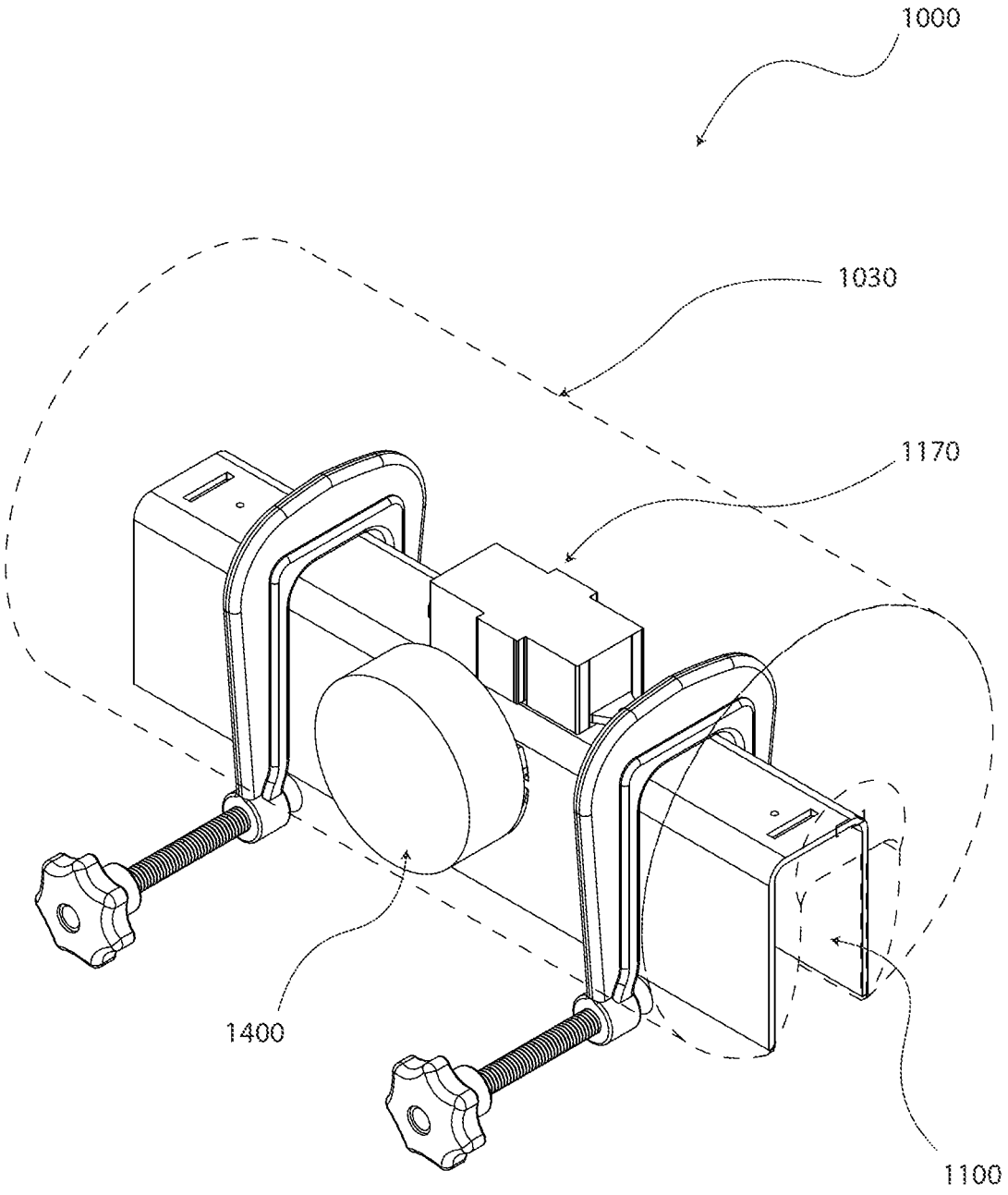
Figure 7B:
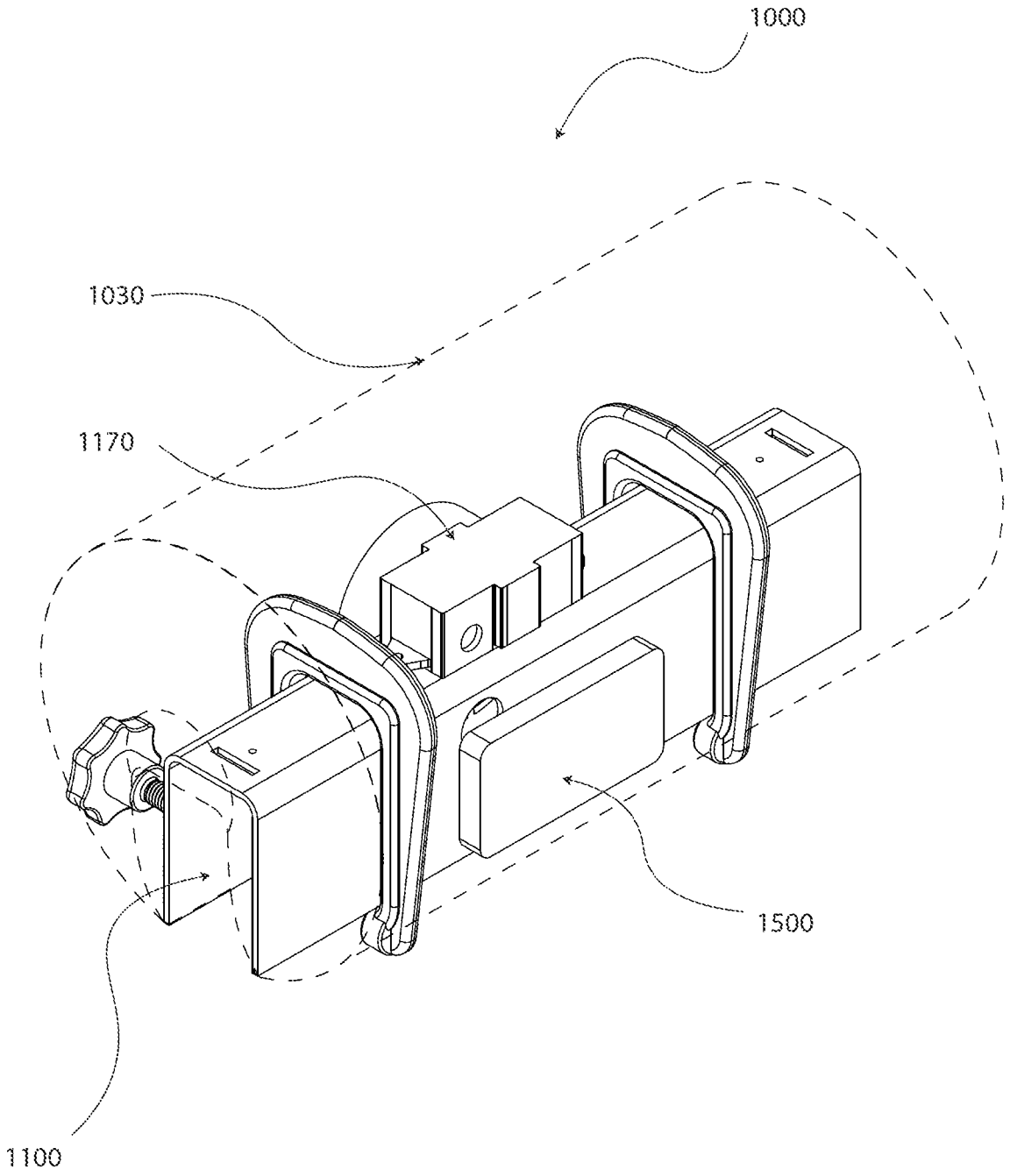

Certain embodiments of the present invention, shown in FIG. 7A-FIG. 7B for instance, comprise a speaker 1400 located between the longitudinal recess 1100 and the external aspect 1030 of the tattoo rest apparatus. The speaker 1400 allows the playing of music during use of the tattoo rest apparatus 1000. Embodiments wherein the speaker comprises an internal power supply, and those wherein the speaker relies upon a battery 1500 are within the spirit and scope of the present invention. Furthermore, embodiments comprising a speaker having wireless communication capabilities—such as Bluetooth® or Wi-Fi®—to allow playing music wirelessly, and embodiments comprising a speaker having wired communication capabilities are within the spirit and scope of the present invention.

Certain embodiments of the present invention comprise a tattoo rest apparatus comprising a battery 1500 interconnected therewith. In certain embodiments the battery 1500 is located between the longitudinal recess 1100 and an external aspect 1030 of the tattoo rest apparatus. In certain embodiments the battery 1500 is electrically connected with a speaker 1400 to provide power to the speaker 1400. In certain embodiments, the battery 1500 is electrically interconnected with a USB connection 1600 interconnected with the external aspect 1030 of the tattoo rest apparatus, such as found at the first end 1010 or second end 1020 of the tattoo rest apparatus.

Figure 8:
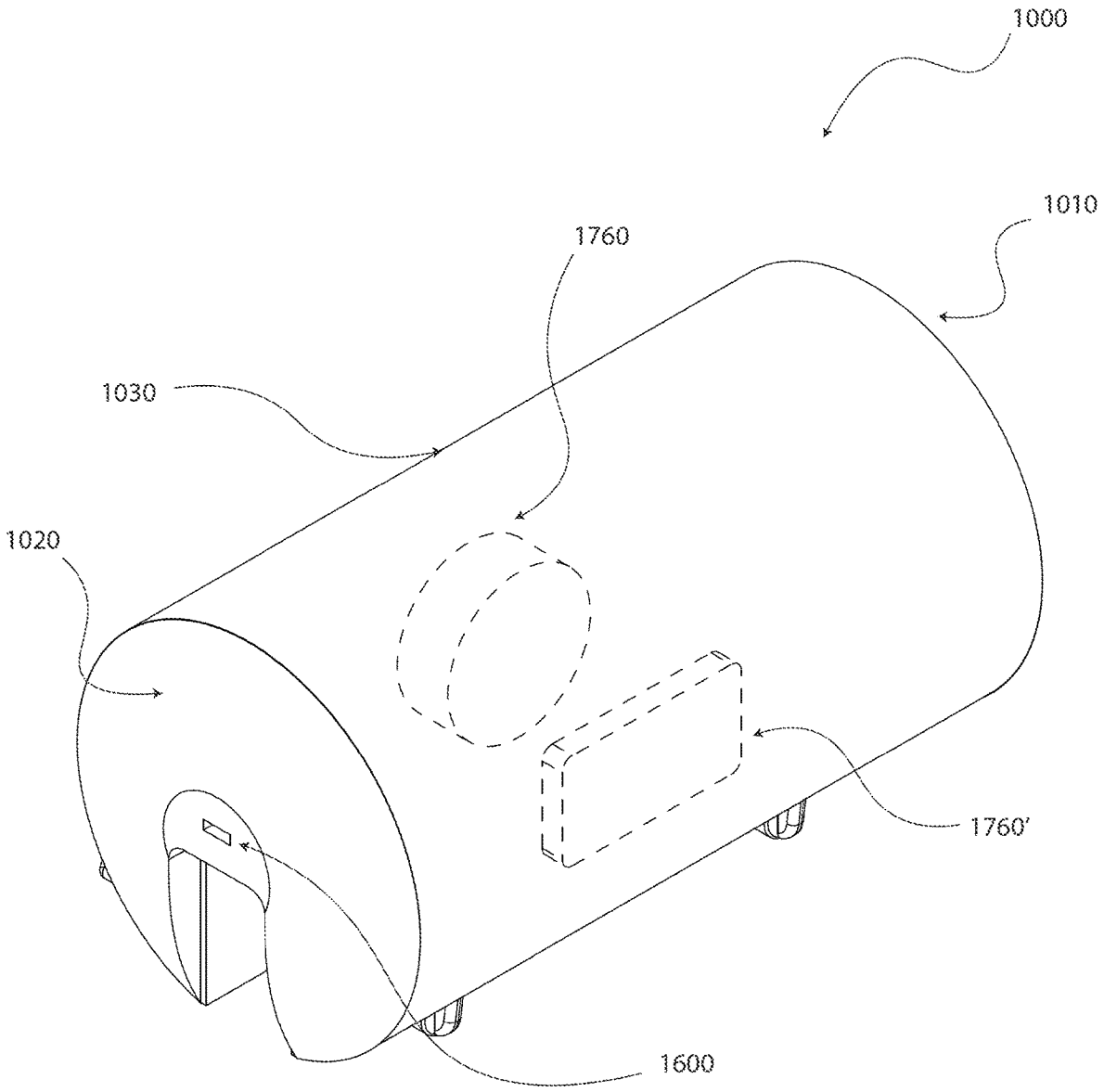

In certain embodiments, as shown in FIG. 8 for instance, the tattoo rest apparatus 1000 comprises a USB 1600 connection on an external surface 1030 of a first end 1010 or second end 1020 of the tattoo rest apparatus. A USB connection 1600 which is interconnected with the battery 1500 allows a user to draw power from the battery 1500, or provide power to the battery 1500 for the purposes of charging the battery 1500. In certain embodiments it may be desired to allow a user to connect with the USB connection 1600 to charge a secondary device, such as a smart phone. In certain embodiments the USB connection 1600 comprises a connection to the battery 1500 and the speaker 1400 wherein a user can charge a secondary device while playing music through the speaker 1400 through the wired connection. In certain embodiments, a USB powered light 1800 (FIG. 5) is removably interconnectable with the USB connection 1600 to provide increased light for better visibility. While a USB port is described and shown in various embodiments, alternate ports known in the art which provide electrical connection are within the spirit and scope of the present invention.

In certain embodiments, as shown in FIG. 4, and FIG. 7A-FIG. 7B for instance, the tattoo rest apparatus 1000 alternatively comprises a USB connection 1600 disposed within the longitudinal recess 1100. The wired connection comprises a USB cable contained within a recess 1170 within the longitudinal recess. In such embodiments a USB cable 1610 having interconnection with the battery 1500 is stored within a USB recess 1170 within the longitudinal recess. In certain embodiments the USB recess comprises a cover 1180 which can be removed for access to the USB connection 1600 therein. In certain embodiments, the USB connection 1600 can be used to recharge the battery 1500.

Figure 9:
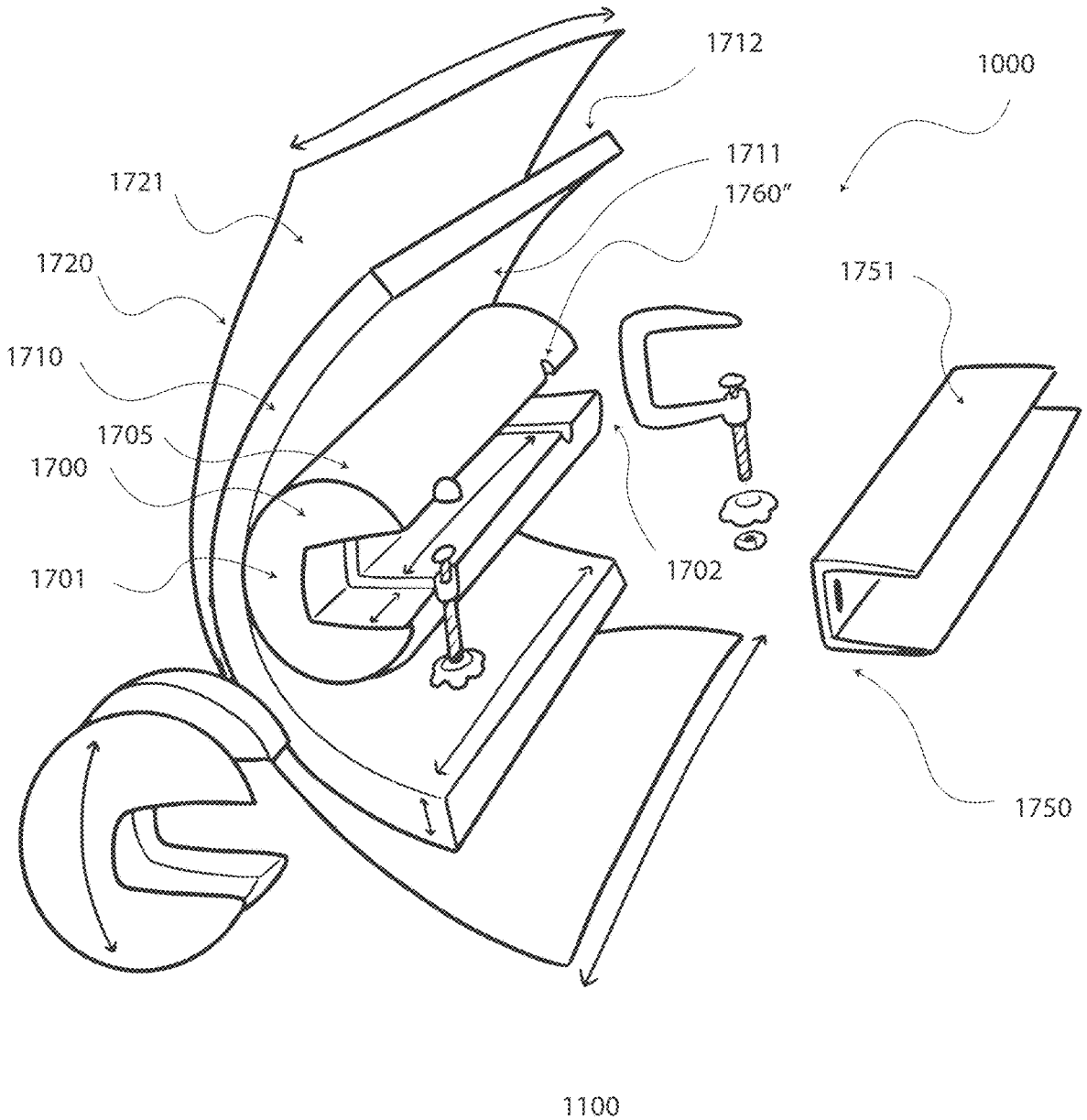
Figure 10:
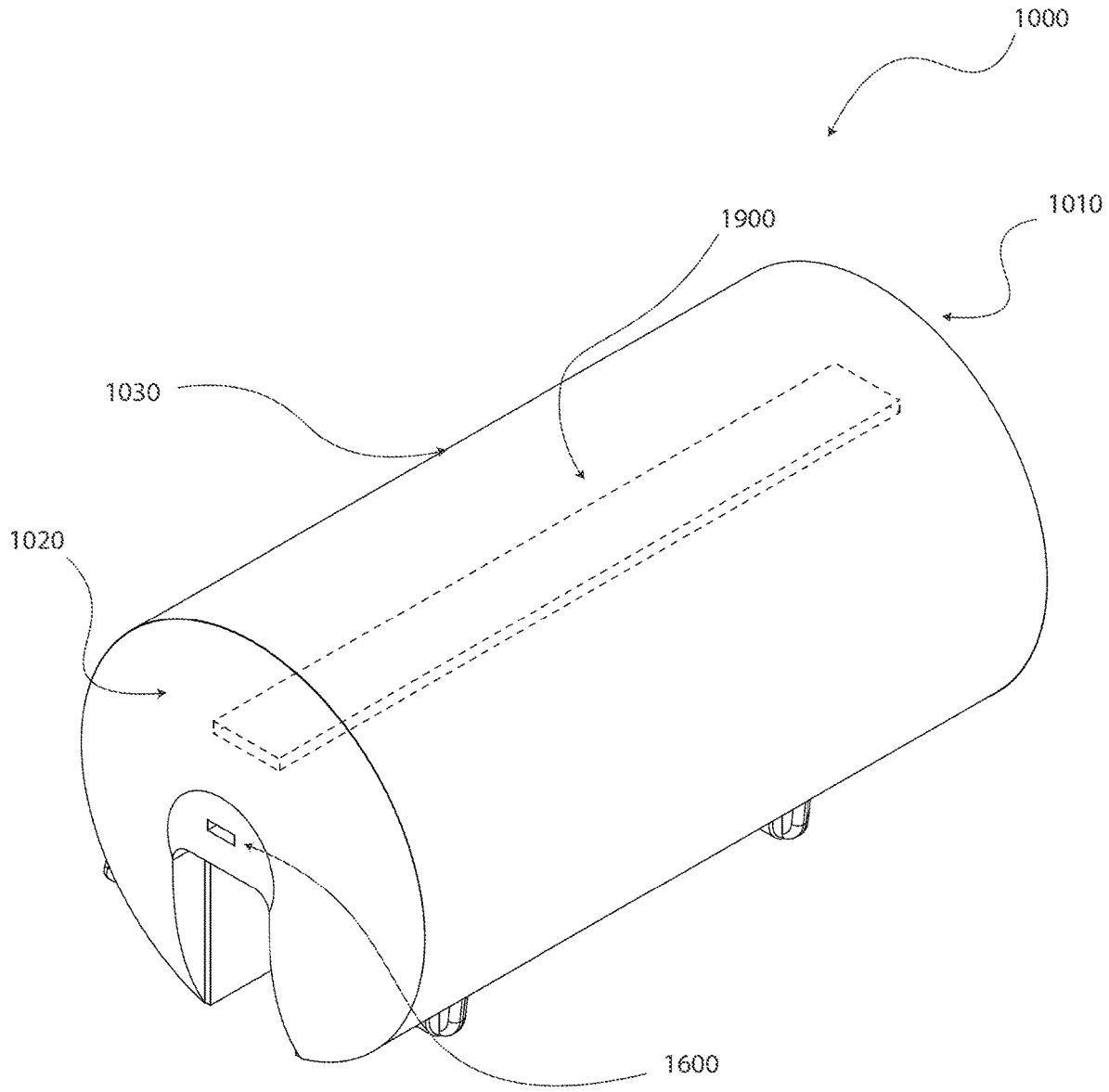

In certain embodiments, as shown in FIG. 7A-FIG. 7B and FIG. 9 for instance, the tattoo rest apparatus 1000 comprises at least a longitudinal core 1700 having a first end 1701 and a second end 1702, wherein the longitudinal core 1700 surrounds a channel 1750. The longitudinal core 1700 comprises a longitudinal recess 1100 wherein an outer surface 1751 of the channel is interconnected therein. While a U-shaped channel as shown is desired in certain embodiments, alternate embodiments comprise different shaped channels are within the spirit and scope of the present invention. The longitudinal core 1700 typically comprises a polymeric foam structure such as a polyethylene-based foam, but embodiments disclosed herein are not limited thereto. Longitudinal cores 1700 comprising materials such as polyethylene foam, EVA foam, HDPE, ABS, or other solid or foam-based structure are within the spirit and scope of the present invention. Alternate embodiments comprising a hollowed-out tube, extruded form, or solid material for the longitudinal core 1700 are within the spirit and scope of the present invention. Furthermore, the material selection for the longitudinal core 1700 is not limited to the use of foam. Alternate embodiments wherein the longitudinal core 1700 comprises plastic, aluminum, wood, or a combination thereof are within the spirit and scope of the present invention.

Between the longitudinal core 1700 and the channel 1750, elements such as clamping elements 1200, a speaker 1400, battery 1500, and USB recess 1170 are interconnected thereto. In certain embodiments, the channel 1750 further comprises rectilinear apertures 1300 (FIG. 4) for the interconnection of the tattoo rest apparatus to a roller stand 9000 as seen in FIG. 6.

In certain embodiments, as shown in FIG. 7A-FIG. 9 for instance, it may be desired to cut recesses 1760 in the longitudinal core 1700 for the positioning of elements such as a speaker recess 1760, the battery recess 1760', and a clamp recess 1760" in between the longitudinal core 1700 and the channel 1750. The recesses 1760 allow the placement of components without the need for added structures which may otherwise complicate manufacturing or assembly processes.

In certain embodiments, as shown in FIG. 2-FIG. 4 and FIG. 9-FIG. 10 for example, it may be desired to incorporate a rigid or semi-rigid structure within the longitudinal core 1700. The structure, or fastener strip 1900 provides a substrate through which a screw or other mechanical fastener can be driven through the channel 1750, through the longitudinal core 1700, and into the fastener strip 1900 to further constrain the channel 1750 within the longitudinal recess 1100 of the longitudinal core. The fastener strip 1900 may comprise wood, plastic, metals, composite materials, or a combination thereof while keeping with the spirit and scope of the present invention. In certain embodiments the channel 1750 further comprise at least one screw hole 1920 wherethrough a screw can be inserted therethrough for fastening. The fastener strip 1900 can be inserted into the longitudinal core 1700 such as through the first end 1701 or through the second end 1702 of the longitudinal core. It may be further desired to use adhesive to constrain the fastener strip in place. While embodiments wherein the fastener strip 1900 are inserted longitudinally through a first end or second end of the longitudinal core are described, other methods of embedding a fastener strip within or around the longitudinal core are within the spirit and scope of the present invention.

Certain embodiments of the present invention further comprise a deformable layer 1710, wherein a first side 1711 of the deformable layer is interconnected to the outer surface 1705 of the longitudinal core, to provide a more comfortable surface with use. The deformable layer 1710 of certain embodiments comprise a foam such as a polyurethane foam, a viscoelastic polyurethane foam, or latex foam—although embodiments are not limited thereto. Alternate embodiments comprising other deformable material layers such as cotton batting, down fill, or polyester fill are within the spirit and scope of the present invention.

Certain embodiments of the present invention further comprise an outer nonporous layer 1720 wherein a first side 1721 of the nonporous layer is interconnected to the outer surface 1705 of the longitudinal core, or alternatively to the second surface 1712 of the deformable layer. The nonporous layer allows the tattoo rest apparatus 1000 to be cleaned and disinfected with common cleaners without negatively affecting the layers thereunder. While it is preferred to use a nonporous layer 1720 as an outer surface in certain embodiments, alternate embodiments which use a porous layer as an outer layer are within the spirit and scope of the present invention. Alternate layers such as wool, polyester, cotton used in conjunction with the nonporous layer 1720 or in lieu of the nonporous layer 1720 are within the spirit and scope of the present invention.

Certain embodiments comprise a channel 1750 having at least one, but preferably a plurality of speaker apertures 1755 through a sidewall 1752 of the channel. The speaker apertures 1755 are adapted to allow the sound emitted from the speaker 1500 to emanate therethrough.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A tattoo rest apparatus comprising:

a longitudinal core;

a longitudinal recess extending longitudinally from a first end of the longitudinal core to a second end of the longitudinal core, and the longitudinal recess comprising a width measured laterally across the longitudinal recess;

a first clamping element and a second clamping element interconnected to the longitudinal core wherein the clamping elements are configured to span the width of the longitudinal recess, and wherein the clamping elements are adapted for clamping to an object inserted within the longitudinal recess;

a nonporous outer layer; and a U-shaped channel interconnected within the longitudinal recess, wherein an outer surface of the U-shaped channel is interconnected with an internal surface of the longitudinal recess.

2. The tattoo rest apparatus of claim 1 further comprising a deformable layer located between the longitudinal core and the nonporous outer layer.

3. The tattoo rest apparatus of claim 2, wherein a first surface of the deformable layer is interconnected to an outer surface of the longitudinal core, and a second surface of the deformable layer is interconnected to a first surface of the nonporous outer layer, wherein a second surface of the nonporous outer layer is directed outward from the tattoo rest apparatus.

4. The tattoo rest apparatus of claim 3, further comprising a first aperture and a second aperture through a bottom surface of the longitudinal recess, wherein the apertures are adapted for receiving a first tab and a second tab of a utility stand therein.

5. The tattoo rest apparatus of claim 4, wherein the apertures are rectilinear in shape and are located in proximity to a first end of the tattoo rest apparatus, and a second end of the tattoo rest apparatus respectively.

6. The tattoo rest apparatus of claim 3, wherein the tattoo rest apparatus comprises a generally round cross-section extending from a first end of the tattoo rest apparatus to a second end of the tattoo rest apparatus.

7. The tattoo rest apparatus of claim 3, wherein the tattoo rest apparatus comprises a consistent cross section extending from a first end of the tattoo rest apparatus to a second end of the tattoo rest apparatus.

8. The tattoo rest apparatus of claim 1, further comprising a power supply located internally within the tattoo rest apparatus.

9. The tattoo rest apparatus of claim 8 further comprising a speaker located internally within the tattoo rest apparatus, wherein the speaker is electrically connected with the power supply.

10. The tattoo rest apparatus of claim 9, wherein the speaker is configured to be wirelessly controlled.

11. The tattoo rest apparatus of claim 9, further comprising an electrical port, wherein the electrical port is electrically interconnected to the power supply.

12. The tattoo rest apparatus of claim 11, wherein the electrical port is interconnected to a first end of the tattoo rest apparatus.

13. The tattoo rest apparatus of claim 11, wherein the electrical port comprises a USB port.

14. The tattoo rest apparatus of claim 13, wherein the USB port is further electrically interconnected with the speaker.

15. The tattoo rest apparatus of claim 14, further comprising a USB powered light which is configured to be removably interconnected with the USB port.

16. The tattoo rest apparatus of claim 11, wherein the electrical port comprises a USB cable disposed within a recess within the longitudinal recess.

17. A tattoo rest apparatus comprising:

a longitudinal core;

a longitudinal recess extending from a first end of the longitudinal core to a second end of the longitudinal core, and the longitudinal recess comprising a width;

a U-shaped channel interconnected within the longitudinal recess, wherein an outer surface of the U-shaped channel is configured to interconnect with an internal surface of the longitudinal recess;

a first clamping element and a second clamping element interconnected to the U-shaped channel configured to span the width of the longitudinal recess wherein the clamping elements are adapted for clamping to an object inserted within the U-shaped channel;

a deformable layer having a first side interconnected with an external surface of the longitudinal core;

a nonporous layer interconnected with a second side of the deformable layer;

a wireless speaker located between the longitudinal recess and an external aspect of the tattoo rest apparatus;

a power supply located between the longitudinal recess and the external aspect;

the power supply having electrical connection with the wireless speaker and with a USB port located at a first end of the tattoo rest apparatus; and a USB powered light configured to be removably interconnected with the USB port, wherein the clamping elements are adapted for applying clamping pressure across the width of the longitudinal recess and apply compressive pressure upon an object inserted within the longitudinal recess, and wherein the tattoo rest apparatus comprises a generally round cross-section extending from the first end of the tattoo rest apparatus to a second end of the tattoo rest apparatus.

* * * * *